US005580050A

United States Patent [19]

Jaatinen et al.

[11] Patent Number: 5,580,050

[45] Date of Patent: Dec. 3, 1996

[54] SHAFT FOR A FLOOR BALL/INDOOR BANDY STICK

[75] Inventors: Pauli Jaatinen; Taisto Manninen; Pekka Tiikkainen, all of Mäntyharju, Finland

[73] Assignee: Exel Oy, Mantyharju, Finland

[21] Appl. No.: 220,908

[22] Filed: Mar. 31, 1994

[30] Foreign Application Priority Data

Apr. 23, 1993 [FI] Finland ..... U930241

[51] Int. Cl.[6] ..... A63B 59/00

[52] U.S. Cl. ..... 273/67 A; 473/316

[58] Field of Search ..... 273/56, 57.2, 67 R, 273/72 R, 72 A, 75, 73 G, 73 J, 81 R, 80 R, 83, 67 A, 67 C, 67 D, 67 DA; 16/DIG. 19, 110 R; D8/DIG. 6, DIG. 7; 81/20, 489, 490; 294/51

[56] References Cited

U.S. PATENT DOCUMENTS

| | | | |
|---|---|---|---|
| 2,874,738 | 2/1959 | Lay | 81/20 |
| 3,089,525 | 5/1963 | Palmer | 273/73 J |
| 5,088,733 | 2/1992 | Barnea et al. | 273/72 A |

FOREIGN PATENT DOCUMENTS

| | | | |
|---|---|---|---|
| 15540 | 12/1991 | Finland . | |
| 15539 | 12/1991 | Finland . | |
| 7604108 | 10/1977 | Netherlands | 273/67 A |
| 1121051 | 7/1968 | United Kingdom | 273/67 A |
| 1446332 | 8/1976 | United Kingdom | 16/110 R |

OTHER PUBLICATIONS

Jolly Floorball brochure (1991) by Total Sport, Tobo, Sweden.

*Primary Examiner*—V. Millin
*Assistant Examiner*—William M. Pierce
*Attorney, Agent, or Firm*—Price, Heneveld, Cooper, DeWitt & Litton

[57] ABSTRACT

A shaft for an indoor bandy stick, comprising a hollow tube. The tube has a substantially circular bottom end which turns elliptical when progressing upwards while the tube expands conically. The ellipse has a major axis (a) which at its maximum is at least about 15%, preferably about 30% longer than its minor axis and the conicity is such that the diameter of the ellipse parallel to the major axis (a) increases at least about 30%, preferably about 50% or more and the diameter parallel to the minor axis (b) increases 0–30%.

11 Claims, 1 Drawing Sheet

SHAFT FOR A FLOOR BALL/INDOOR BANDY STICK

BACKGROUND OF THE INVENTION

The present invention relates to a floorball or indoor bandy stick, comprising a hollow tube. The shaft may consist e.g. of fibers bound by hardened resin or possibly also of plastics or a metal.

It is prior known to use a cross-sectionally circular or elliptical tube for making a shaft for an indoor bandy stick. The prior known shaft tubes have a cross-section of the same shape and size over the entire length thereof. A drawback with a circular shaft tube is a poor feel over the position of a stick, nor does it provide a firm handgrip. In the case of an elliptical or oval tube, it is also inevitable to make a compromise between a firm handgrip, the flexibility characteristics as well as the strength and total weight of a shaft.

SUMMARY OF THE INVENTION

An object of the invention is to provide an improved shaft for an indoor bandy stick, bearing in mind both the requirements for a good handgrip and the flexibility and lightness of a shaft, yet without sacrificing any of the strength.

This object is achieved on the basis of the characterizing features set forth in the annexed claims.

The oval or elliptical top section of a shaft provides a good handgrip. A tapered or conical appearance provides preferred flexibility characteristics (bottom section more flexible than top section) considering the action that indoor bandy sticks are intended for. A tapered bottom section also adds to the strength by virtue of a greater wall thickness. As a result of this, the overall weight of a shaft can be slightly reduced.

BRIEF DESCRIPTION OF THE DRAWINGS

The invention will now be described in more detail with reference made to the accompanying drawings, in which.

DESCRIPTION OF THE PREFERRED EMBODIMENTS

Figure 1:
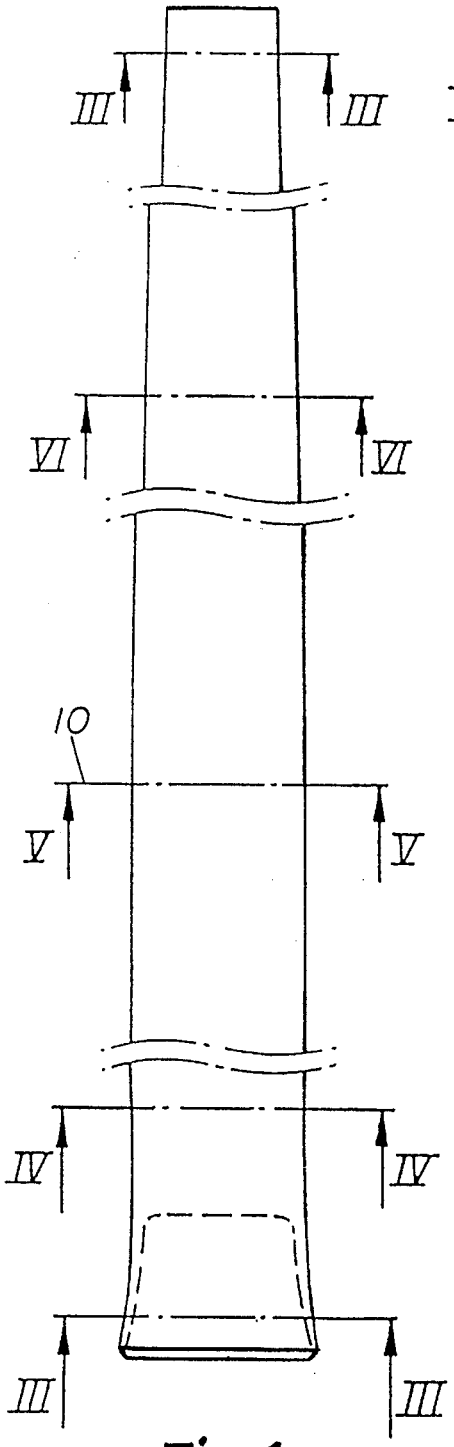
FIG. 1 shows a shaft of the invention for an indoor bandy stick in a side view and FIG. 2 shows the same shaft rotated through 90° relative to FIG. 1, i.e. in the direction of the plane of the blade of a stick.
Figure 2:
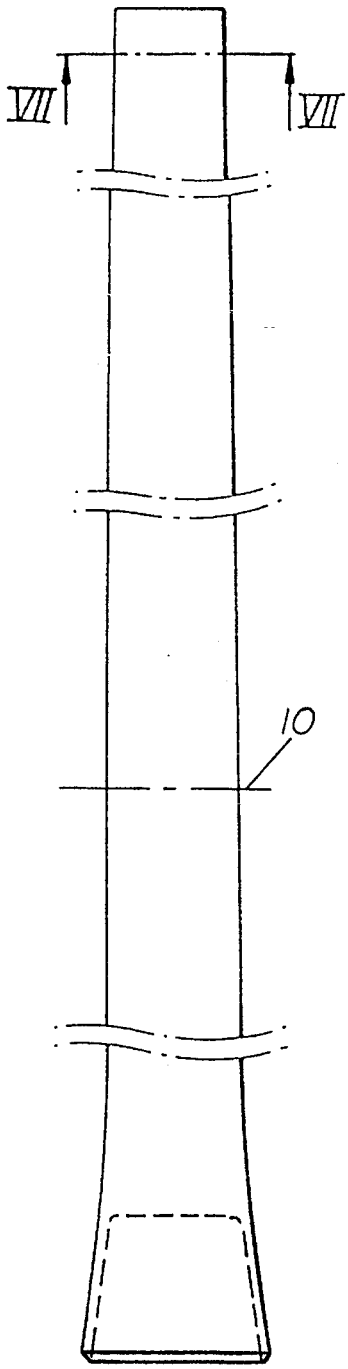
Figure 7:
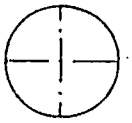
FIGS. 3–7 illustrate sections taken from FIG. 1 with a corresponding numbering, whereby section III—III is across a plug driven into the top end of a shaft, section IV-IV is from near the top end of a shaft, section V-V is from the mid-point of a shaft, the distance of section VI-VI from the bottom end of a shaft is roughly one third of the length of a shaft, and section VII—VII is from the bottom end of a shaft.
Figure 6:
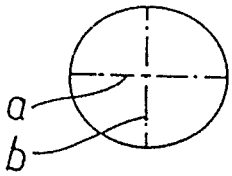
Figure 5:
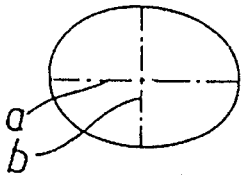
Figure 4:
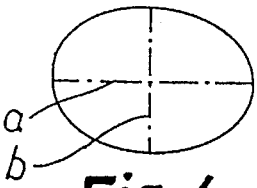
Figure 3:
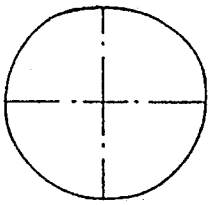

FIGS. 3–7 show the transformation of the cross-sectional size and shape over the length of a shaft. The circular cross-section shown in FIG. 7 has an external diameter of e.g. 18,5 mm. The elliptical cross-section shown in FIG. 6 has a minor axis b of 20,5 mm and a major axis a of 24 mm. In FIG. 5, taken at the midpoint of the shaft as shown in FIGS. 1 and 2 at line 10, the minor axis b is 21,5 mm and the major axis a is 28 mm, i.e. the major axis is about 30% longer than the minor axis. In FIG. 4, the minor axis b is 22 mm and the major axis a is 29 mm, i.e. the major axis is about 32% longer than the minor axis. Since the dimension of 18,5 mm the increase of the major axis to the dimension of 29 mm represents the increase of a shaft diameter of about 55% in the direction of major axis a. In the direction of the minor axis the increase from 18,5 mm to the dimension of 22 mm represents the increase of about 19%. Typically, the increase of diameter in the direction of minor axis b is within the range of 0–30% while the increase of diameter in the direction of major axis a, when progressing from the bottom end to the top end of a shaft, is within the range of 30–70%. The meaning of this is that a substantially circular cross-section transforms into a sort of elliptical cross-section while the shaft tube is conically expanding.

For the top end of a shaft to provide a good gripping zone over as long a stretch as possible, the degrees of conicity and ellipticity are substantially greater below the midway point of a shaft than thereabove. Thus, the entire handgrip zone of a shaft will have an appropriate thickness and ellipticity. However, the diameter of the bottom end of a shaft remains small, whereby the shaft will be slightly flexible and all in all light to handle. However, the bottom end of a shaft has a sufficient strength also in the lateral direction by virtue of a circular cross-section.

The shaft tube has a wall thickness of about 1,0–2,0 mm, e.g. about 1,5 mm, and preferably it can be made partly of longitudinal and partly of wound-around fibers, which are bound together with hardened resin. Around the shaft between its midway point and top end is wound a soft, adhesive-friction improving tape.

The embodiments of the invention in which an exclusive property or privilege is claimed are as follows:

1. A shaft for an indoor bandy stick, comprising a hollow tube having opposed top and bottom ends, characterized in that said top end includes a handgrip area for use as a handle for the shaft, and the cross-sectional shape of said tube is substantially circular at said bottom end, said cross-sectional shape becoming elliptical progressing from said bottom end toward said top end while said tube expands conically, the ellipse of said elliptical cross-sectional shape having a major axis (a), a minor axis (b), a diameter parallel to said major axis (a), and a diameter parallel to said minor axis (b), said major axis (a) at its maximum being within the range of 15% to 30% longer than said minor axis, the conicity of said tube being such that said diameter of said ellipse parallel to said major axis (a) increases within the range of 30% to 70%, and said diameter parallel to said minor axis (b) increases within the range of 0 to 30%.

2. A shaft for a floorball/indoor bandy stick comprising:

a hollow tube having top and bottom ends and an intermediate section therebetween, said top end including a handgrip area for use as a handle for the shaft, said bottom end being circular in cross section and opposite said top end, said intermediate section expanding conically over at least a portion of its length when progressing toward said top end and having at least a portion which is elliptical, said elliptical portion having major and minor axes, said major axis being longer than said minor axis, said major axis being aligned and generally parallel to the direction of the plane of a blade adapted for use with said shaft.

3. The shaft of claim 2 wherein said tube is selected from a material in the group consisting of fibers bound by a hardened resin, plastic and metal.

4. The shaft of claim 2 wherein said elliptical portion of said intermediate section has a major and a minor axis at any one cross section, said major axis increasing in length within the range of between 30% and 70% when progressing from said bottom end toward said top end, said minor axis increasing in length within the range of between 0 and 30% when progressing from said bottom end toward said top end.

5. The shaft of claim 4 wherein said increase in length of said major axis is 50%.

6. The shaft of claim 4 wherein said major axis at its maximum length increases in length with respect to said minor axis when progressing from said bottom end toward said top end within the range of between 15% and 30%.

7. A shaft for a floorball/indoor bandy stick comprising:

a hollow tube having top and bottom ends and an intermediate section therebetween, said bottom end being circular in cross section, said intermediate section expanding conically over at least a portion of its length when progressing toward said top end and having at least a portion which is elliptical;

said shaft having a midpoint, the conicity and ellipticity of said hollow tube increasing when progressing from said bottom end toward said top end, the degree of increase in said conicity and ellipticity being greater between said bottom end and said midpoint than between said midpoint and said top end.

8. The shaft of claim 2 wherein said shaft has a midpoint; said tube having friction improving tape wound around said handgrip area between said midpoint and said top end in said handgrip area.

9. A shaft for a floorball/indoor bandy stick comprising:

a hollow tube having top and bottom ends and an intermediate section therebetween, said top end including a handgrip area for use as a handle for the shaft, said bottom end being circular in cross section and opposite said top end, said shaft defining an outer surface which is elliptical or oval along at least a portion of said intermediate section, said portion of said intermediate section having said elliptical or oval outer surface including major and minor axes, said major axis being longer than said minor axis, said major axis being aligned and generally parallel to the direction of the plane of a blade adapted for use with said shaft.

10. The shaft of claim 9 including a handgrip area having friction improving tape wound on at least part of said elliptical or oval outer surface portion of said intermediate section in said handgrip area.

11. The shaft of claim 10 wherein said tube is selected from a material in the group consisting of fibers bound by a hardened resin, plastic and metal.

* * * * *